US009016945B2

(12) United States Patent
Fraser et al.

(10) Patent No.: US 9,016,945 B2
(45) Date of Patent: Apr. 28, 2015

(54) BAG AND METHOD OF MAKING THE SAME

(75) Inventors: Robert W. Fraser, Willowbrook, IL (US); Kyle R. Wilcoxen, Willowbrook, IL (US)

(73) Assignee: The Glad Products Company, Oakland, CA (US)

( * ) Notice: Subject to any disclaimer, the term of this patent is extended or adjusted under 35 U.S.C. 154(b) by 483 days.

(21) Appl. No.: 13/433,149

(22) Filed: Mar. 28, 2012

(65) Prior Publication Data

US 2012/0214657 A1 Aug. 23, 2012

Related U.S. Application Data

(63) Continuation-in-part of application No. 12/574,894, filed on Oct. 7, 2009, now abandoned.

(60) Provisional application No. 61/106,784, filed on Oct. 20, 2008.

(51) Int. Cl.

| | |
|---|---|
| ***B65D 30/10*** | (2006.01) |
| ***B31B 19/26*** | (2006.01) |
| ***B31B 19/90*** | (2006.01) |
| ***B31B 23/00*** | (2006.01) |
| ***B31B 41/00*** | (2006.01) |
| ***B65D 33/00*** | (2006.01) |
| ***B65F 1/00*** | (2006.01) |

(52) U.S. Cl.

CPC ..... *B31B 19/26* (2013.01); *B31B 19/90* (2013.01); *B31B 23/00* (2013.01); *B31B 41/00* (2013.01); *B31B 2219/2681* (2013.01); *B31B 2219/9029* (2013.01); *B31B 2219/9035* (2013.01); *B31B 2237/10* (2013.01); *B31B 2237/40* (2013.01); *B31B 2237/406* (2013.01); *B31B 2237/50* (2013.01); *B31B 2241/00* (2013.01); *B65D 33/00* (2013.01); *B65F 1/0006* (2013.01)

(58) Field of Classification Search

USPC ..... 493/186, 189, 193, 199, 210, 214, 243, 493/267; 428/156; 383/120

See application file for complete search history.

(56) References Cited

U.S. PATENT DOCUMENTS

| | | | | | |
|---|---|---|---|---|---|
| 2,146,753 | A | * | 2/1939 | Luckhaupt | 426/77 |
| 3,029,853 | A | | 4/1962 | Piazze | |
| 3,411,698 | A | * | 11/1968 | Reynolds | 383/35 |
| 3,687,357 | A | * | 8/1972 | Hansen | 383/72 |
| 3,889,871 | A | * | 6/1975 | White | 383/203 |
| 4,153,664 | A | * | 5/1979 | Sabee | 264/280 |
| 4,343,848 | A | * | 8/1982 | Leonard, Jr. | 428/156 |
| 4,558,463 | A | * | 12/1985 | Boyd | 383/75 |
| 4,650,451 | A | * | 3/1987 | Herrington | 493/190 |
| 4,753,629 | A | * | 6/1988 | Powell et al. | 493/193 |
| 4,881,933 | A | * | 11/1989 | Wech | 493/225 |
| 5,028,289 | A | | 7/1991 | Rasmussen | |
| 5,057,065 | A | * | 10/1991 | Buchman | 493/194 |
| 5,205,650 | A | | 4/1993 | Rasmussen | |
| 5,455,992 | A | | 10/1995 | Kurschatke et al. | |

(Continued)

*Primary Examiner* — Gloria R Weeks

(74) *Attorney, Agent, or Firm* — Thomas C. Feix

(57) ABSTRACT

The plastic bag may include flexible thermoplastic sidewalls that have a pattern imparted onto them. The wrinkle pattern may be a plurality of linear ribs formed into the sidewall that may be arranged adjacent and parallel to one another. To impart the pattern to the sidewall, a thermoplastic web used to make the sidewall may be directed between a first cylindrical roller and a second cylindrical roller, each of which may have a plurality of spaced ridges extending about their peripheries. When the web is directed between the first and second rollers, the meshing of the ridges may form ribs into the web.

20 Claims, 15 Drawing Sheets

(56) References Cited

U.S. PATENT DOCUMENTS

| | | | | |
|---|---|---|---|---|
| 5,554,093 | A * | 9/1996 | Porchia et al. | 493/240 |
| 5,618,111 | A * | 4/1997 | Porchia et al. | 383/63 |
| 6,059,458 | A * | 5/2000 | Belias et al. | 383/75 |
| 6,139,186 | A | 10/2000 | Fraser | |
| 6,150,647 | A * | 11/2000 | Anderson et al. | 219/730 |
| 6,264,872 | B1 | 7/2001 | Majors et al. | |
| 6,394,651 | B2 * | 5/2002 | Jackson | 383/75 |
| 6,394,652 | B2 | 5/2002 | Meyer et al. | |
| 6,602,174 | B1 * | 8/2003 | Haverfield et al. | 493/191 |
| 7,077,796 | B2 * | 7/2006 | Rusnak et al. | 493/215 |
| 7,938,635 | B2 * | 5/2011 | Heilman et al. | 425/101 |
| 7,942,577 | B2 * | 5/2011 | Fraser et al. | 383/72 |
| 8,734,016 | B2 * | 5/2014 | Borchardt et al. | 383/105 |
| 2003/0125180 | A1 * | 7/2003 | Sosalla | 493/423 |
| 2005/0143243 | A1 * | 6/2005 | Lee | 493/186 |
| 2006/0093766 | A1 | 5/2006 | Savicki et al. | |
| 2006/0177161 | A1 | 8/2006 | Turvey | |
| 2007/0254120 | A1 * | 11/2007 | Rasmussen | 428/35.7 |
| 2008/0227611 | A1 * | 9/2008 | Aspenns et al. | 493/267 |
| 2008/0260996 | A1 * | 10/2008 | Heilman et al. | 428/141 |
| 2009/0003738 | A1 | 1/2009 | Hall | |
| 2010/0098354 | A1 | 4/2010 | Fraser et al. | |
| 2011/0117307 | A1 * | 5/2011 | Fraser et al. | 428/66.6 |
| 2011/0293208 | A1 * | 12/2011 | Cheema et al. | 383/205 |
| 2012/0039550 | A1 * | 2/2012 | MacPherson et al. | 383/109 |
| 2012/0063706 | A1 * | 3/2012 | Fraser et al. | 383/109 |
| 2012/0088645 | A1 * | 4/2012 | Fraser et al. | 493/241 |
| 2012/0214657 | A1 * | 8/2012 | Fraser et al. | 493/243 |
| 2013/0011084 | A1 * | 1/2013 | Broering et al. | 383/42 |
| 2013/0055900 | A1 * | 3/2013 | Sauer et al. | 96/135 |

* cited by examiner

BAG AND METHOD OF MAKING THE SAME

CROSS REFERENCE TO RELATED APPLICATIONS

This continuation-in-part application claims the benefit of U.S. application Ser. No. 12/574,894, filed Oct. 7, 2009 now abandoned which claims the benefit of U.S. Provisional Application No. 61/106,784, filed Oct. 20, 2008, which are hereby incorporated by reference in their entirety.

BRIEF SUMMARY

Among their many applications, it is known to use thermoplastic bags as liners in trash or refuse receptacles. Trash receptacles that employ such liners may be found at many locations, such as, small household kitchen garbage cans. Bags that are intended to be used as liners for such refuse containers are typically made from low-cost, pliable thermoplastic material. When the receptacle is full, the thermoplastic liner actually holding the trash may be removed for further disposal and replaced with a new liner.

It is desirable to reduce the cost of producing the disposable thermoplastic bags as much as possible. Therefore, such bags typically are mass-produced in a high speed manufacturing environment. Other cost savings can be realized by reducing the amount or quality of thermoplastic material utilized to make the bag. However, reducing the amount or quality of thermoplastic material forming the bag limits bag strength and toughness and makes the bag susceptible to tearing or rupture. Accordingly, there is a need for a thermoplastic bag designed in a manner that reduces material cost while maintaining strength and toughness characteristics and facilitating high-speed manufacturing.

A thermoplastic bag provided for use as a trash receptacle liner may be formed with sidewalls of flexible thermoplastic material. The sidewalls may be arranged to provide an interior volume for receiving and holding trash or refuse. At least a portion of the thermoplastic sidewalls may be processed to have a ribbed pattern. The ribbed pattern may be a plurality of linearly arranged and substantially parallel ribs imparted into the sidewall material.

To provide a thermoplastic bag having the ribbed pattern, various high-speed manufacturing processes may be provided that process continuous webs of thermoplastic material into the finished bags. The manufacturing processes may utilize a pair of cylindrical rollers, arranged in parallel and aligned adjacently together. Each cylindrical roller may include a plurality of circular ridges that protrude radially about their cylindrical surfaces. The circular ridges may be arranged in parallel and may be spaced apart along the longitudinal axis of the cylindrical roller. Moreover, the circular ridges on the pair of rollers may be arranged to intermesh such that the protruding ridges on the first roller are received between the protruding ridges on the second roller.

In operation, a continuous web of the thermoplastic material may be directed along a machine direction between the first and second rollers, which may be rotated around their respective longitudinal axes in opposite rotational directions. The intermeshing circular ridges and grooves may direct the web material into the corresponding corrugated or ribbed pattern. As may be appreciated, as the web is directed between the rollers, a series of parallel ribs may be formed into the web.

The rollers may be spaced apart and arranged to reduce the thickness of the processed web. One possible advantage of processing the web between the rollers is that the web material may be worked. Thus, the resulting ribbed pattern may have more permanence and resilience when subsequently distorted. Another possible advantage is that reducing the thickness of the web between the rollers may stretch and may compress some of the web material longitudinally and perpendicularly of a machine direction in which the web is proceeding. Thus, the web material may be widened. The web may receive additional processing to form a finished bag for use as a liner.

In another aspect, only a portion of the web may be directed between the rollers with the remaining portion passing beyond the cylindrical length of the rollers so that only a portion of the web may be imparted with the ribbed pattern. In the embodiments in which the average thickness of the web may be reduced by processing between the rollers, the portion of the web corresponding to the ribbed pattern may have a reduced average thickness compared to the remainder of the web that may be relatively thicker.

High-speed processing equipment or apparatuses may be provided for processing thermoplastic webs into bags having ribbed patterns. The processing equipment may utilize a pair of parallel, adjacent rollers having intermeshing circular ridges.

A possible advantage of the thermoplastic bag formed with a ribbed pattern is that strengthening and toughness characteristics may be achieved as compared to prior art thermoplastic bags lacking such a ribbed pattern. Another possible advantage is that imparting the thermoplastic web with the ribbed pattern may increase the width of the web by stretching a portion of the web material which is passed between the rollers. Another possible advantage to increasing the web width is that larger liner bags may be manufactured from less thermoplastic material, thereby resulting in cost savings. Another possible advantage is that the thickness of the webs that form the finished bag liners may vary to provide more thermoplastic material to different portions of the bag liners where additional material is desired while taking advantage of thicker bag properties. These and further advantages and features will become apparent from the description and the accompanying drawings.

DESCRIPTION

Figure 1:
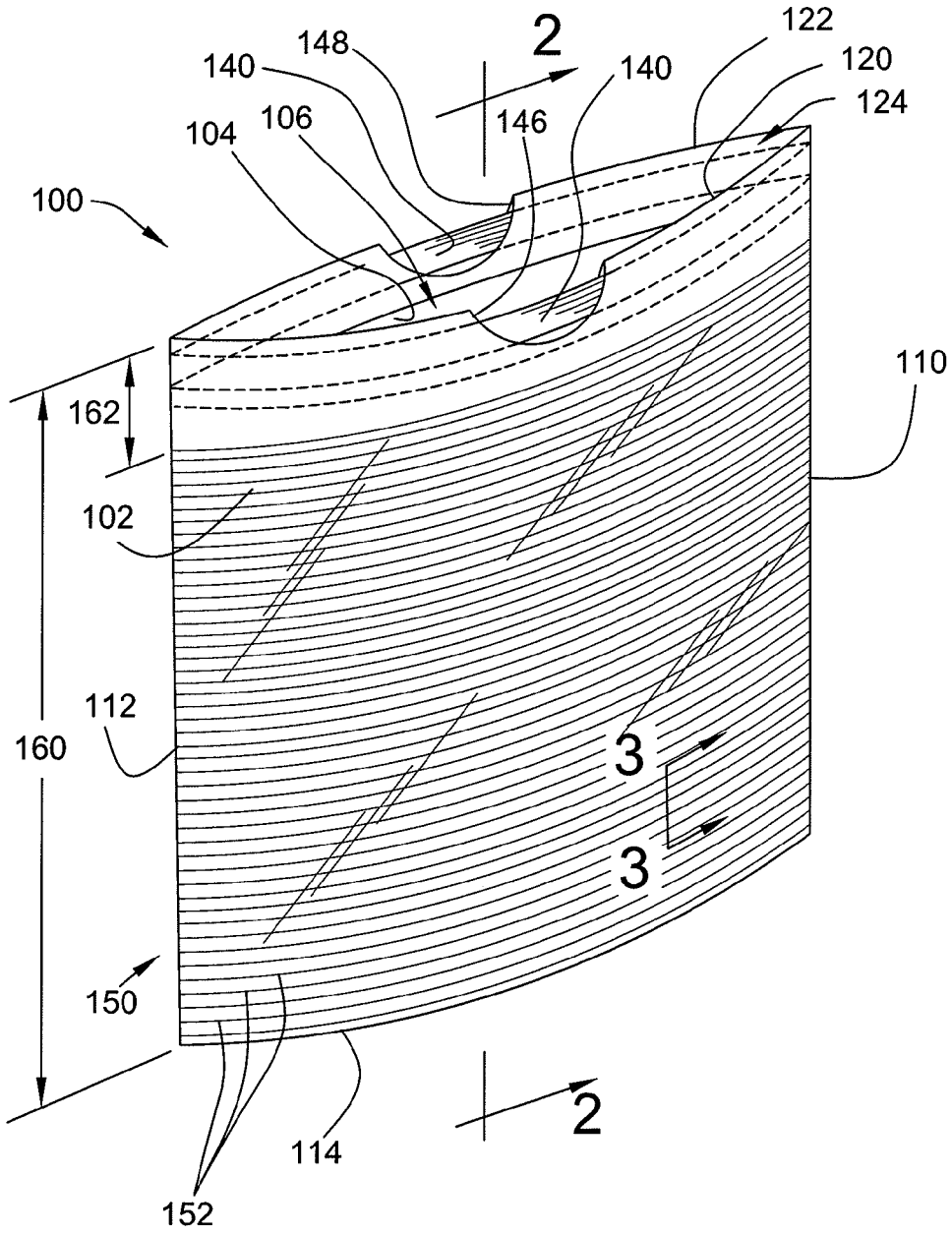
FIG. 1 is a perspective view of a thermoplastic bag for use as a trash container liner having a ribbed pattern imparted onto a sidewall of the bag.

Referring to FIG. 1, an embodiment of a flexible thermoplastic bag 100 is illustrated. While flexible bags are generally capable of holding a vast variety of different contents, the bag 100 illustrated in FIG. 1 may be intended to be used as a liner for a garbage can or similar refuse container. The bag 100 may be made from a first sidewall 102 and an opposing second sidewall 104 overlying the first sidewall to provide an interior volume 106 therebetween. The first and second sidewalls 102, 104 may be joined along a first side edge 110, a parallel or non-parallel second side edge 112, and a closed bottom edge 114 that may extend between the first and second side edges. The sidewalls 102, 104 may be joined along the first and second side edges 110, 112 and bottom edge 114 by any suitable process such as, for example, heat sealing. The bottom edge 114 may be formed by joining the first sidewall 102 to the second sidewall 104 by any suitable process. The bottom edge 114 may be formed by a fold between the first sidewall 102 and the second sidewall 104.

Figure 2:
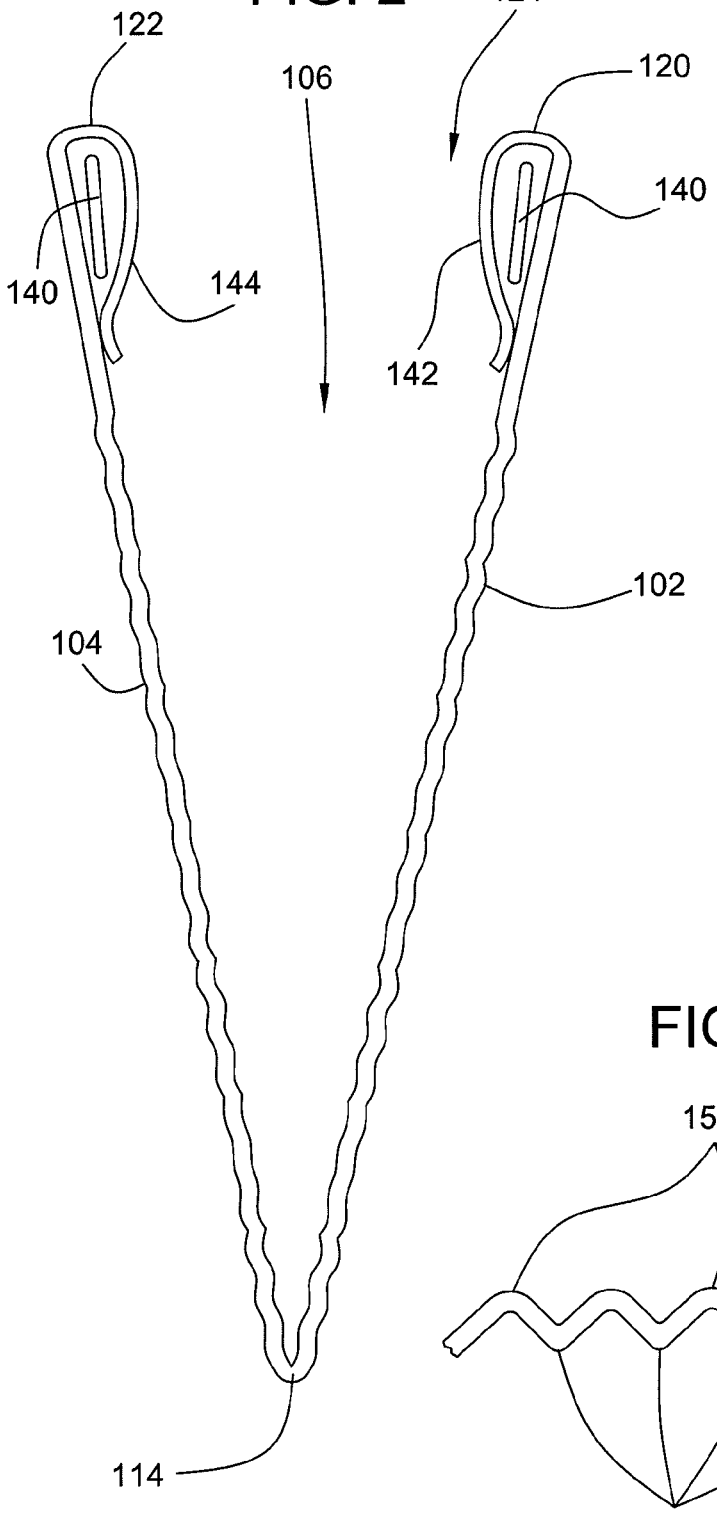
FIG. 2 is a cross-sectional view taken along line 2-2 of FIG. 1.

For accessing the interior volume 106 to, for example, insert refuse or garbage, the top edges 120, 122 of the first and second sidewalls 102, 104 may remain un-joined to define an opening 124 located opposite the closed bottom edge 114. When placed in a trash receptacle, the top edges 120, 122 of the first and second sidewalls 102, 104 may be folded over the rim of the receptacle. To close the opening 124 of the bag 100 when, for example, disposing of the trash receptacle liner, referring to FIGS. 1 and 2, the bag may be fitted with a draw tape 140. To accommodate the draw tape 140, referring to FIG. 2, the first top edge 120 of the first sidewall 102 may be folded back into the interior volume 106 and attached to the interior surface of the sidewall to form a first hem 142. Similarly, the second top edge 122 of the second sidewall 104 may be folded back into the interior volume and attached to the second sidewall to form a second hem 144. In other embodiments, the hems may be folded to the exterior and attached to the exterior surface of the sidewall(s). The draw tape 140, which may be fixedly attached at the first and second side edges 110, 112, may extend along the first and second top edge 120, 122 through the first and second hems 142, 144. To access the draw tape 140, first and second notches 146, 148 may be disposed through the respective first and second top edges 120, 122. Pulling the draw tape 140 through the notches 146, 148 may constrict the top edges 120, 122 thereby closing the opening 124.

The first and second sidewalls 102, 104 of the plastic bag 100 may be made of flexible or pliable thermoplastic material which may be formed or drawn into a web or sheet. Examples of suitable thermoplastic material may include polyethylene, such as, high density polyethylene, low density polyethylene, very low density polyethylene, ultra low density polyethylene, linear low density polyethylene, polypropylene, ethylene vinyl acetate, nylon, polyester, ethylene vinyl alcohol, ethylene methyl acrylate, ethylene ethyl acrylate, or other materials, or combinations thereof, and may be formed in combinations and in single or multiple layers. When used as a garbage can liner, the thermoplastic material may be opaque but in other applications may be transparent, translucent, or tinted. Furthermore, the material used for the sidewalls may be a gas impermeable material.

Figure 3:
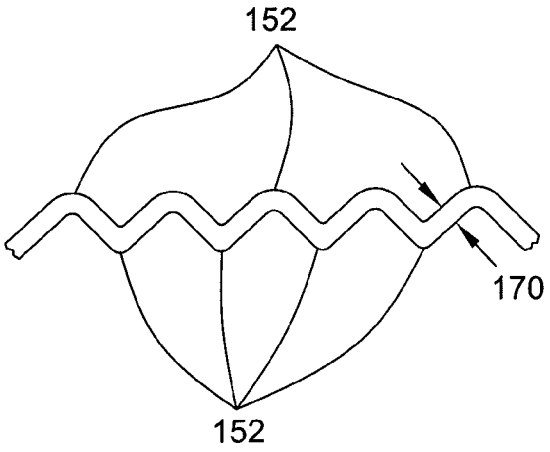
FIG. 3 is cross-sectional view taken along line 3-3 of FIG. 1.

Referring to FIGS. 1 and 3, to provide the bag with desirable physical characteristics, a ribbed pattern 150 may be imparted onto at least a portion of the first sidewall of the bag. The ribbed pattern 150 may take the form of a plurality of linear ribs 152 that may extend across the first sidewall 102 substantially between the first side edge 110 and second side edge 112. As illustrated in FIG. 3, the ribs 152 may be parallel and adjacent to one another such that the thermoplastic material of the sidewall 102 may have a generally corrugated shape. Additionally, as illustrated in FIG. 1, the ribbed pattern 150 may extend from the bottom edge 114 toward the opening 124. To avoid interfering with the operation of the draw tape 140, the extension of the ribbed pattern 150 may terminate below the opening 124. The bag 100 may have a height 160 measured between the closed bottom edge 114 and the opening 124. The height 160 may have a first range of about 10 inches (25.4 cm) to 48 inches (121.9 cm), a second range of about 24 inches (61 cm) to 40 inches (101.6 cm), and a third range of about 27 inches (68.6 cm) to 36 inches (91.4 cm). In one embodiment, the height 160 may be about 27.4 inches (69.6 cm). The ribbed pattern 150 can terminate a distance 162 below the opening. The distance 162 can have a first range of about 1.5 inches (3.8 cm) to 6 inches (15.2 cm), a second range of about 2 inches (5.1 cm) to 5 inches (12.7 cm), and a third range of about 2.25 inches (5.7 cm) to 4 inches (10.2 cm). In one embodiment, the distance 162 may be about 2.75 inches (7 cm).

Figures 4, 5:
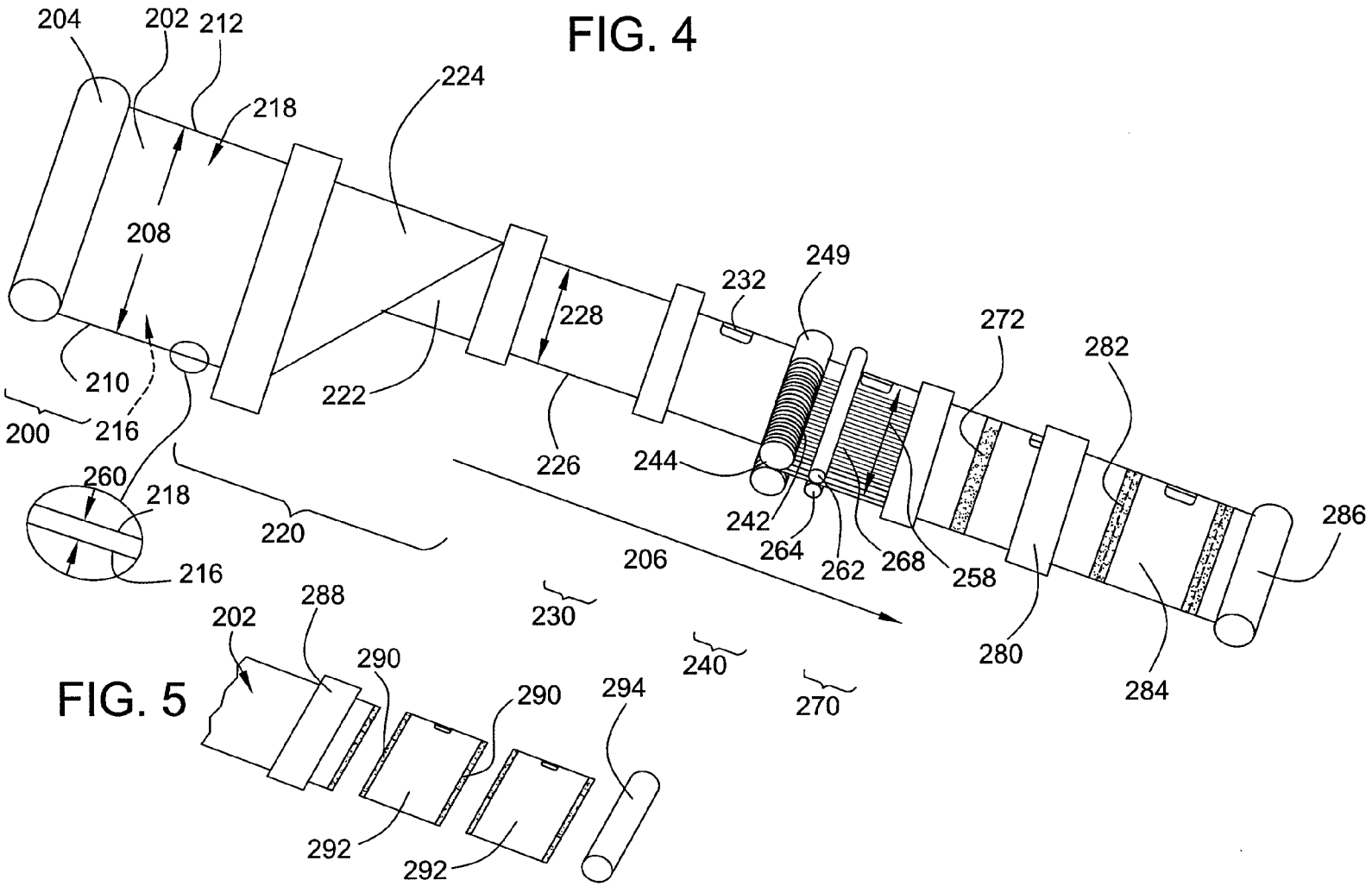
FIG. 4 is a schematic view depicting a high-speed manufacturing process for producing thermoplastic bags having ribbed patterns from a continuous web of thermoplastic material.
FIG. 5 is a schematic view of the final steps of another embodiment of the high-speed manufacturing process.

To produce a bag having a ribbed pattern as described, continuous webs of thermoplastic material may be processed through a high-speed manufacturing environment such as illustrated in FIG. 4. In the illustrated process, production may begin in a step 200 by unwinding a continuous web 202 of thermoplastic sheet material from a roll 204 and advancing the web along a machine direction 206. The unwound web 202 may have a width 208 that may be perpendicular to the machine direction 206 as measured between a first edge 210 and an opposite second edge 212. The unwound web 202 may have an initial average thickness measured between a first surface 216 and a second surface 218. In other manufacturing environments, the web 202 may be provided in other forms or even extruded directly from a thermoplastic forming process.

To provide the first and second sidewalls of the finished bag, the web 202 may be folded into a first half 222 and an opposing second half 224 about the machine direction 206 by a folding operation 220. When so folded, the first edge 210 may be moved adjacent to the second edge 212 of the web. Accordingly, the width of the web proceeding in the machine direction 206 after the folding operation 220 may be a width 228 that may be half the initial width 208 after the unwinding step 200. As may be appreciated, the portion mid-width of the unwound web 202 may become the outer edge 226 of the folded web. In another embodiment, the roll 204 may include a pre-folded web and the folding operation is not necessary. The hems may be formed along the adjacent first and second edges 210, 212 and the draw tape 232 may be inserted during a hem and draw tape operation 230.

To impart the ribbed pattern, the processing equipment may include a first cylindrical roller 242 and a parallel, adjacently arranged second cylindrical roller 244 that may accomplish the imparting process 240. The rollers 242, 244 may be arranged so that their longitudinal axes may be perpendicular to the machine direction 206 and may be adapted to rotate about their longitudinal axes in opposite rotational directions. In various embodiments, motors may be provided that power rotation of the rollers 242, 244 in a controlled manner. The cylindrical rollers may be made of cast and/or machined metal such as steel or aluminum.

Figure 6:
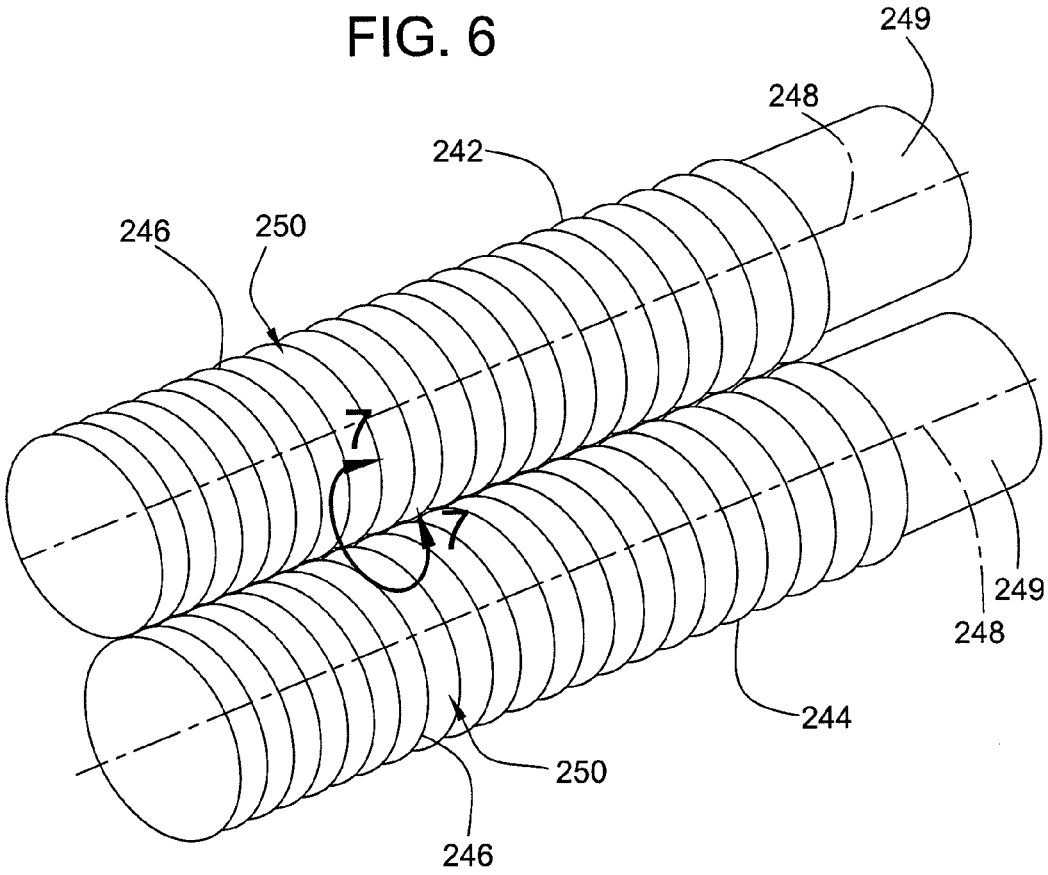
FIG. 6 is a perspective view of the cylindrical rollers, arranged in parallel and adjacent to each other, used to impart the ribbed pattern onto a thermoplastic web.
Figure 7:
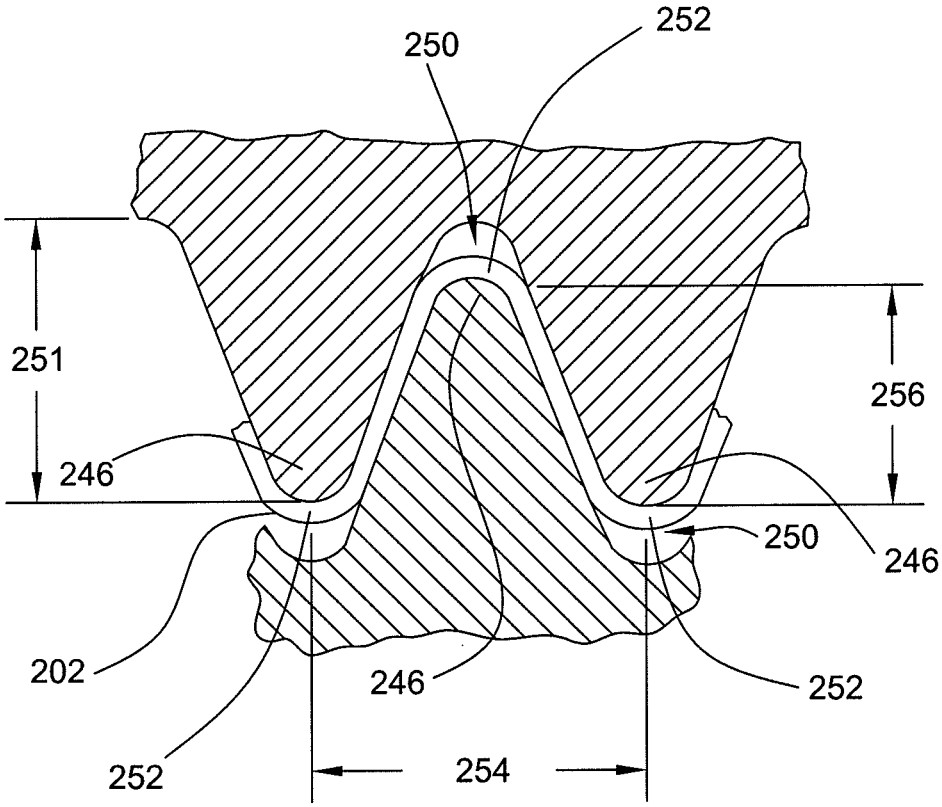
FIG. 7 is a view of the cylindrical rollers taken along circle 7-7 of FIG. 6 depicting the intermeshing of the cylindrical rollers including the protruding circular ridges and the accommodating grooves.

Referring to FIGS. 6 and 7, the cylindrical surface of both the first and second rollers 242, 244 may include a plurality of protruding ridges 246 that may encircle the cylindrical axis 248. The circular ridges 246 may be arranged parallel to one another and may extend along the axial length of the cylinder. Moreover, the circular ridges 246 may be spaced apart from one another to provide corresponding grooves 250 therebetween. The pattern of the circular ridges 246 on the first roller 242 may be axially offset or staggered with respect to the pattern of circular ridges on the second roller 244 such that, when the rollers are aligned adjacently, the ridges of each roller may be received in and accommodated by the grooves 250 of the other roller. In this sense, the alternating ridges and grooves of the two cylindrical rollers may mesh together.

The rollers and the ridge and groove features may have any suitable dimensions, taking into consideration the web material and web size to be processed. The ridges 246 may have a peak height 251 in a first range of about 0.02 inches (0.05 cm) to 0.4 inches (1.02 cm), a second range of about 0.04 inches (0.1 cm) to 0.2 inches (0.51 cm), and a third range of about 0.06 inches (0.15 cm) to 0.15 inches (0.38 cm). In one embodiment, the peak height 251 may be about 0.08 inches (0.2 cm). The ridges 246 may have a peak to peak spacing, or pitch 254, in a first range of about 0.02 inches (0.05 cm) to 0.15 inches (0.38 cm), a second range of about 0.03 inches (0.08 cm) to 0.075 inches (0.19 cm), and a third range of about 0.035 inches (0.09 cm) to 0.05 inches (0.13 cm). In one embodiment, the pitch 254 may be about 0.04 inches (0.1 cm). The ridges may have a height to pitch ratio in a first range of about 0.5:1 to 4:1, a second range of about 1:1 to 3:1, and a third range of about 1.5:1 to 2.5:1. In one embodiment, the height to pitch ratio may be about 2:1. The longitudinal axes 248 of the rollers 242, 244 may be spaced apart such that only a portion of the circular ridge 246 is received in the corresponding groove 250. The height of the ridge 246 that is actually received within the groove 250 may be termed depth of engagement 256. The depth of engagement 256 may have a first range of about 0.01 inches (0.025 cm) to 0.055 inches (0.14 cm), a second range of about 0.02 inches (0.05 cm) to 0.045 inches (0.11 cm), and a third range of about 0.025 inches (0.06 cm) to 0.035 inches (0.09 cm). In one embodiment, the depth of engagement 256 may be about 0.03 inches (0.08 cm).

Referring to FIG. 4, the folded web 202 may be advanced along the machine direction 206 between the first and second rollers 242, 244 which may be set into rotation in opposite rotational directions to impart the resulting web pattern 268. As illustrated in FIG. 7, the ridges 246 may stretch the web 202 into the corresponding grooves 250. The stretching may occur in tensile and shear modes. Also, the meshing action of the ridges and grooves may compress the web. The meshing action of the ridges 246 and grooves 250 may impart onto the web 202 a corrugated or ribbed pattern or shape. The arrangement of alternating circular ridges 246 and corresponding grooves 250 may produce a series of linear ribs 252 onto the web 202, which the web may at least partially maintain after passing between the rollers. Because the circular ridges 246 may be aligned in parallel and spaced apart, the resulting ribs 252 imparted to the web may be parallel to one another and may have the same spacing or pitch. To facilitate patterning of the web 202, the first roller 242 and second roller 244 may be forced or directed against each other by, for example, hydraulic actuators. The pressure at which the rollers are pressed together may be in a first range from 30 PSI (2.04 atm) to 100 PSI (6.8 atm), a second range from 60 PSI (4.08 atm) to 90 PSI (6.12 atm), and a third range from 75 PSI (5.10 atm) to 85 PSI (5.78 atm). In one embodiment, the pressure may be about 80 PSI (5.44 atm).

In the illustrated embodiment, the first and second rollers may be arranged so that they are co-extensive with or wider than the width 228 of the folded web. In one embodiment, the rollers 242, 244 may extend from proximate the outer edge 226 to the adjacent edges 210, 212. To avert imparting the ribbed pattern onto the portion of the web that includes the draw tape 232, the corresponding ends 249 of the rollers 242, 244 may be smooth and without the ridges and grooves. Thus, the adjacent edges 210, 212 and the corresponding portion of the web proximate those edges that pass between the smooth ends 249 of the rollers 242, 244 may not be ribbed.

In one embodiment, the web 202 may be stretched to reduce its thickness as it passes between the rollers. Referring to FIG. 4, the web when it is unwound from the roll 204 may have an average thickness 260, measured between the first surface 216 and a second surface 218. The average thickness 260 may have a first range of about 0.0007 inches (0.0018 cm) to 0.0014 inches (0.0036 cm), a second range of about 0.0008 inches (0.002 cm) to 0.0012 inches (0.003 cm), and a third range of about 0.0009 inches (0.0023 cm) to 0.0011 inches (0.0028 cm). In one embodiment, the average thickness may be 0.001 inches (0.0025 cm). After passing between the rollers 242, 244, the web may have an average thickness 170 as shown in FIG. 3 that is reduced. The average thickness 170 may be in a first range of about 0.0005 inches (0.0013 cm) to 0.0012 inches (0.003 cm), a second range of 0.0006 inches (0.0015 cm) to 0.0009 inches (0.0023 cm), and a third range of about 0.00065 inches (0.0017 cm) to 0.0008 inches (0.002 cm). In one embodiment, the average thickness 170 may be about 0.0007 inches (0.0018 cm). The average thickness may reduced to 85% or less of the original average thickness, or to 90% or less of the first average thickness, or to 80% or less of the first average thickness, or to 70% or less of the first average thickness. Of course, other reductions in average thickness may be possible and may be achieved by varying the initial average thickness of the web, by adjusting spacing of the rollers, and by adjusting the pressure at which the rollers are pressed or forced together.

One result of reducing the thickness of the web material is that the ribbed pattern may be imparted into the web. The thermoplastic material of the web may be stretched or worked during reduction such that the initially planar web takes the new ribbed shape. In some embodiments, the molecular structure of the thermoplastic material may be rearranged to provide this shape memory.

Referring to FIG. 4, another result of reducing the web thickness is that some of the web material may be stretched longitudinally along the rollers 242, 244 and perpendicular to the machine direction 206. Also, some of the web material may be compressed longitudinally along the rollers 242, 244. This action may widen the folded web from its initial width 228 to a larger width 258. To facilitate the widening of the web, the adjacent edges 210, 212 of the web may be located between the smooth ends 249 of the rollers 242, 244. The smooth ends 249 of the rollers 242, 244 can maintain alignment of the web along the machine direction. The processing equipment may include pinch rollers 262, 264 to accommodate the growing width of the widening web.

The processed web may have varying thickness as measured along its width perpendicular of the machine direction. Because the ridges 246 and the grooves 250 on the rollers 242, 244 may not be co-extensive with the width 228 of the folded web 202, only the thickness of that portion of the web which is directed between the ridges and the grooves may be reduced. The remaining portion of the web, such as, toward the adjacent edge 210, 212, may retain the web's original thickness. The smooth ends 249 of the rollers 242, 244 may have diameters dimensioned to accommodate the thickness of that portion of the web which passes therebetween.

To produce the finished bag, the processing equipment may further process the folded web with the ribbed pattern. For example, to form the parallel side edges of the finished bag, the web may proceed through a sealing operation 270 in which heat seals 272 may be formed between the outer edge 226 and the adjacent edges 210, 212. The heat seals may fuse together the adjacent halves 222, 224 of the folded web. The heat seals 272 may be spaced apart along the folded web and in conjunction with the folded outer edge 226 may define individual bags. The heat seals may be made with a heating device, such as, a heated knife. A perforating operation 280 may perforate 282 the heat seals 272 with a perforating device, such as, a perforating knife so that individual bags 290 may be separated from the web. In another embodiment, the web may be folded one or more times before the folded web may be directed through the perforating operation. The web 202 embodying the finished bags 284 may be wound into a roll 286 for packaging and distribution. For example, the roll 286 may be placed in a box or a bag for sale to a customer.

In another embodiment of the process which is illustrated in FIG. 5, a cutting operation 288 may replace the perforating operation 280 in FIG. 4. Referring to FIG. 5, the web is directed through a cutting operation 288 which cuts the web at location 290 into individual bags 292 prior to winding onto a roll 294 for packaging and distribution. For example, the roll 294 may be placed in a box or bag for sale to a customer. The bags may be interleaved prior to winding into the roll 294. In another embodiment, the web may be folded one or more times before the folded web is cut into individual bags. In another embodiment, the bags 292 may be positioned in a box or bag, and not onto the roll 294. The bags may be interleaved prior to positioning in the box or bag.

These manufacturing embodiments may be used with any of the manufacturing embodiments described herein, as appropriate.

A possible advantage of imparting the ribbed pattern onto the sidewall of the finished bag is that toughness of the thermoplastic bag material may be increased. For example, toughness may be measured by the tensile energy to yield of a thermoplastic film or web. This measure represents the energy that the web material may incur as it is pulled or placed in tension before it yields or gives way. The tensile energy to yield quality can be tested and measured according to various methods and standards, such as those set forth in ASTM D882-02, herein incorporated by reference in its entirety.

In particular, a web, which is processed to have a ribbed pattern imparted onto it by rollers, may demonstrate a higher tensile energy to yield in the transverse direction ("TD"), which is perpendicular to the machine direction ("MD") according to which the web is processed. By way of example only, a linear low density polyethylene web having an initial average thickness of 0.0009 inches (0.0023 cm) was run between a pair of rollers having circular ridges at a 0.04 inch (0.1 cm) pitch, a depth of engagement ("DOE") of 0.035 inches (0.09 cm), a roller pressure of 60 PSI (4.08 atm), and a speed of 300 feet per minute (91.4 meters per minute). The web had an initial tensile yield of 1.50 lbf. (6.7 N) in the transverse direction and an initial tensile energy to yield of 0.274 in-lbf (0.031 J) in the transverse direction. After imparting the ribbed pattern, the web had a tensile yield of 1.43 lbf (6.36 N), a tensile energy to yield of 0.896 in-lbf (0.101 J) and an average thickness of 0.00077 inches (0.002 cm). The following table sets forth the change in these values.

TABLE 1

| Characteristic/ Material | Initial Unprocessed Web | Processed Web |
|---|---|---|
| TD Tensile Yield | 1.50 lbf (6.67 N) | 1.43 lbf (6.36 N) |
| TD Tensile Energy To Yield | 0.274 in-lbf (0.031 J) | 0.896 in-lbf (0.101 J) |

By way of further example, a different linear low density polyethylene web having an initial average thickness of 0.0008 inches (0.002 cm) mils was run between a pair of rollers having circular ridges at a 0.04 inch (0.1 cm) pitch and a depth of engagement ("DOE") of 0.02 inches (0.051 cm), a roller pressure of 60 PSI (4.08 atm), and a speed of 300 feet per minute (91.4 meters per minute). The web had an initial tensile yield of 1.39 lbf (6.18 N) in the transverse direction and an initial tensile energy to yield of 0.235 in-lbf (0.027 J) in the transverse direction. After imparting the ribbed pattern, the web had a tensile yield of 1.38 lbf (6.14 N) and a tensile energy to yield of 0.485 in-lbf (0.055 J) and an average thickness of 0.00075 inches (0.0019 cm). The following table sets forth the change in these values.

TABLE 2

| Characteristic/ Material | Initial Unprocessed Web | Processed Web |
|---|---|---|
| TD Tensile Yield | 1.39 lbf (6.18 N) | 1.38 lbf (6.14 N) |
| TD Tensile Energy to Yield | 0.235 in-lbf (0.027 J) | 0.485 in-lbf (0.055 J) |

Thus, imparting the ribbed pattern onto the thermoplastic web may increase the tensile energy to yield by a factor of 2 or greater without a substantial decrease in the tensile yield. When a thermoplastic bag may be manufactured according to the process set forth in FIG. 4, it may be appreciated that the transverse direction of the processed web corresponds to the bag length measured between the closed bottom end and the opened top end. Thus, the toughness of the bag may be increased in the lengthwise direction. The lengthwise direction may be the lift direction of the bag.

Another possible advantage of reducing the thickness of the web via imparting the web with a ribbed pattern is that the ultimate tensile strength may remain relatively consistent even though the web thickness might be reduced. For example, a thermoplastic web having an initial average thickness of 0.0012 inches (0.003 cm) and an ultimate tensile load of about 6.2 lbf (27.6 N) was processed between rollers to impart a ribbed pattern such as those described herein. The web was run between a pair of rollers having circular ridges at a pitch of 0.04 inches (0.1 cm), a depth of engagement of 0.045 inches (0.114 cm), a roller pressure of 40 PSI (2.72 atm), and a speed of 300 feet per minute (91.4 meters per minute). The processed film had an average thickness of about 0.00073 inches (0.00185 cm) and an ultimate tensile load of about 5.8 lbf (25.8 N). The results are set forth in the following table.

TABLE 3

| Material/Characteristic | Average Thickness | Ultimate Tensile Load |
|---|---|---|
| Initial Unprocessed Web | 0.0012 inches (0.003 cm) | 6.2 lbf (27.6 N) |
| Processed Web | 0.00073 inches (0.00185 cm) | 5.8 lbf (25.8 N) |

Another example of the advantages of reducing the thickness of the web without significantly altering the transverse ultimate tensile strength is shown for a web having an initial average thickness of 0.0009 inches (0.0023 cm) and an ultimate tensile load of about 4.8 lbf (21.4 N). The web was processed between rollers to impart a ribbed pattern such as those described herein. The web was run between a pair of rollers having circular ridges at a pitch of 0.04 inches (0.1 cm), a depth of engagement of 0.03 inches (0.076 cm), a roller pressure of 80 PSI (5.44 atm), and a speed of 300 feet per minute (91.4 meters per minute). The processed web had an average thickness of about 0.00073 inches (0.00185 cm) and an ultimate tensile strength of 4.4 lbf (19.6 N). The results are set forth in the following table.

TABLE 4

| Material/Characteristic | Average Thickness | Ultimate Tensile Load |
|---|---|---|
| Initial Unprocessed Web | 0.0009 inches (0.0023 cm) | 4.8 lbf (21.4 N) |
| Processed Web | 0.00073 inches (0.00185 cm) | 4.4 lbf (19.6 N) |

As may be appreciated, even though the average thickness of the 0.0012 inches (0.003 cm) web was reduced by almost 40% from its original average thickness, the ultimate tensile load was only reduced about 6.5%. While the 0.0009 inches (0.0023 cm) average thickness web was reduced by almost 25% from its original average thickness, the ultimate tensile load was only reduced about 8.3%. The comparison between the processed 0.0012 inches (0.003 cm) web and 0.0009 inches (0.0023 cm) web which both were processed to an average thickness of about 0.00073 inches (0.00185 cm), show that the ultimate tensile strength of the processed web is directly related to the initial unprocessed web's ultimate tensile strength. Imparting the ribbed pattern to the web reduces the average thickness in a range of about 5% to 40%, with a corresponding reduction in ultimate tensile load of about 0% to 8.3%. Thus, the ultimate tensile load of the web processed with a ribbed pattern remains substantially consistent with its initial unprocessed web despite having its average thickness reduced.

In addition to the above results, it has also been noticed that imparting the ribbed pattern to the webs made into thermoplastic bags alters the tear resistance of the web. The tear resistance of a thermoplastic web may be measured according to the methods and procedures set forth in ASTM D882-02, herein incorporated by reference in its entirety. By way of example only, a polyethylene web typically has a greater resistance to tear in the transverse direction that is perpendicular to the machine direction in which the web is processed. This web is characterized as having properties imbalanced in the machine direction. However, after passing the web between rollers to impart the ribbed pattern, the tear resistance may be changed. The web may become more balanced where the transverse and machine direction tear resistances may be about equal. Or it may experience greater change to become imbalanced in the transverse direction, where the tear resistance may be switched such that the tear resistance may be greater in the machine direction than in the transverse direction.

Additionally, as described herein, applying the ribbed pattern to just a portion of the web width may result in widening the web. For example, a web may have an initial width of 22.375 inches (56.8 cm) and an initial average thickness of about 0.0014 inches (0.0036 cm). The web may be passed between two rollers such as those described herein which may have ridges and grooves that may be 16.375 (41.6 cm) inches in length. The rollers may be arranged so that the average thickness of the web may be reduced from 0.0014 inches (0.0036 cm) to about 0.0009 inches (0.0023 cm) for that portion passed between the ridges and grooves. The reduction in average thickness may be accompanied by displacement in the web material such that the overall width of the web may expand to about 29.875 inches (75.9 cm), i.e. an increase of about 7.5 inches (19.1 cm). Thus, referring back to FIG. 1, a finished bag 100 made from the processed web may have a greater height measured between the opening 124 and the closed bottom edge 114.

Additionally, as also described herein, because only that portion of the web which passes between the ridges and grooves may have its average thickness reduced, the remaining portion of the web which is made into the bag may remain at the original average thickness of 0.0014 inches (0.0036 cm). The processing equipment may be arranged so that the thicker web material may correspond to those portions of the finished bag in which thicker material is advantageous. For example, referring to FIG. 1, the portion of the web which does not pass through the ridges and grooves may correspond to the top portion of the bag which may include the draw tape 140. Thus, the top portion of the bag may be reinforced by the thicker material. In other embodiments, the web may be processed so that the thicker material may be directed to other portions of the finished bag, such as the bottom portion shown in FIGS. 10, 11 and/or 12, that may otherwise be susceptible to rupture and/or puncture.

A possible advantage may result from arranging the ribbed pattern as a plurality of parallel, linear ribs and only along a portion of the width of the web. In the manufacturing process illustrated in FIG. 4, because the ribbed pattern may be imparted by directing the adjacent web halves 222, 224 between the rollers 242, 244, the ribbed web halves may have a tendency to interlock together. However, because the adjacent edges 210, 212 of the web 202 may be unpatterned, the web halves 222, 224 may be easily separated at the edges in a manner that may provide an impetus for separating a remainder of the web halves. Additionally, the parallel linear arrangement of ribs may facilitate unlocking the web halves. Thus, as may be appreciated, it may be easier to open a finished bag for use as a trash receptacle liner.

Figure 8:
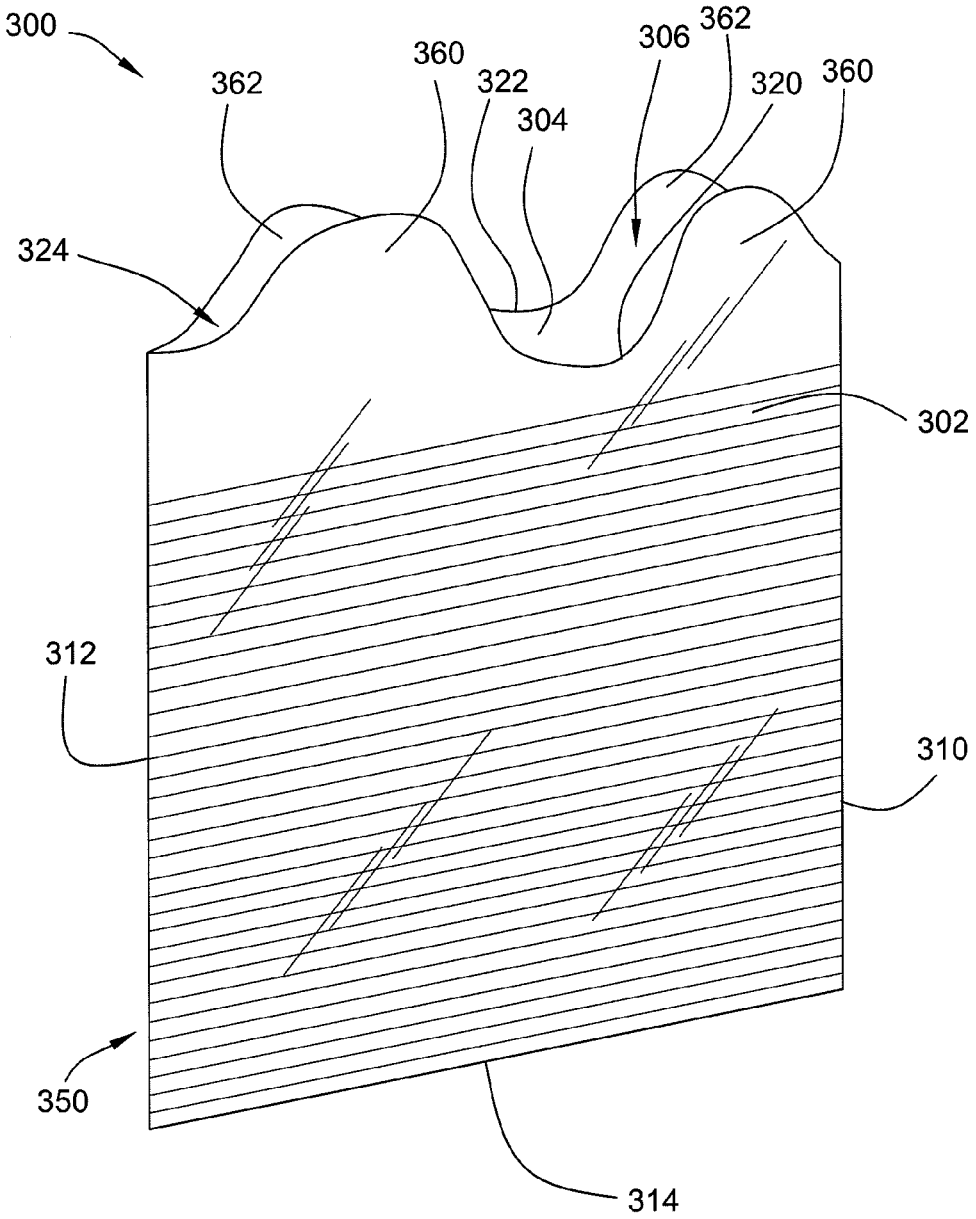
FIG. 8 is a perspective view of another embodiment of the thermoplastic bag for use as a trash receptacle liner having a ribbed pattern imparted onto a sidewall of the bag.

Referring now to FIG. 8, there is illustrated another embodiment of a bag 300 for use as a trash receptacle liner.

The bag 300 may include a first sidewall 302 of thermoplastic material overlaid and joined to a second sidewall 304 of similar material to provide an interior volume 306. The first and second sidewalls 302, 304 may be joined along a first side edge 310, a second side edge 312, and a closed bottom edge 314 extending therebetween. To access the interior volume 306, the top edges 320, 322 of the sidewalls 302, 304 may remain un-joined. The first sidewall 302 of the bag 300 may be provided with a ribbed pattern 350 including a plurality of linear ribs that may run parallel to and may be located between the closed bottom edge 314 and the opening 324. To close and seal the opening 324, the bag 300 may be provided with tie flaps 360, 362 that may extend as part of the top edges 320, 322 of the sidewalls 302, 304. The tie flaps 360, 362 may be tied together when the bag 300 is removed from the receptacle and disposed of. In addition to tie flaps and draw-tapes, other suitable closing mechanisms may include twist ties and mechanical clips.

Figure 9:
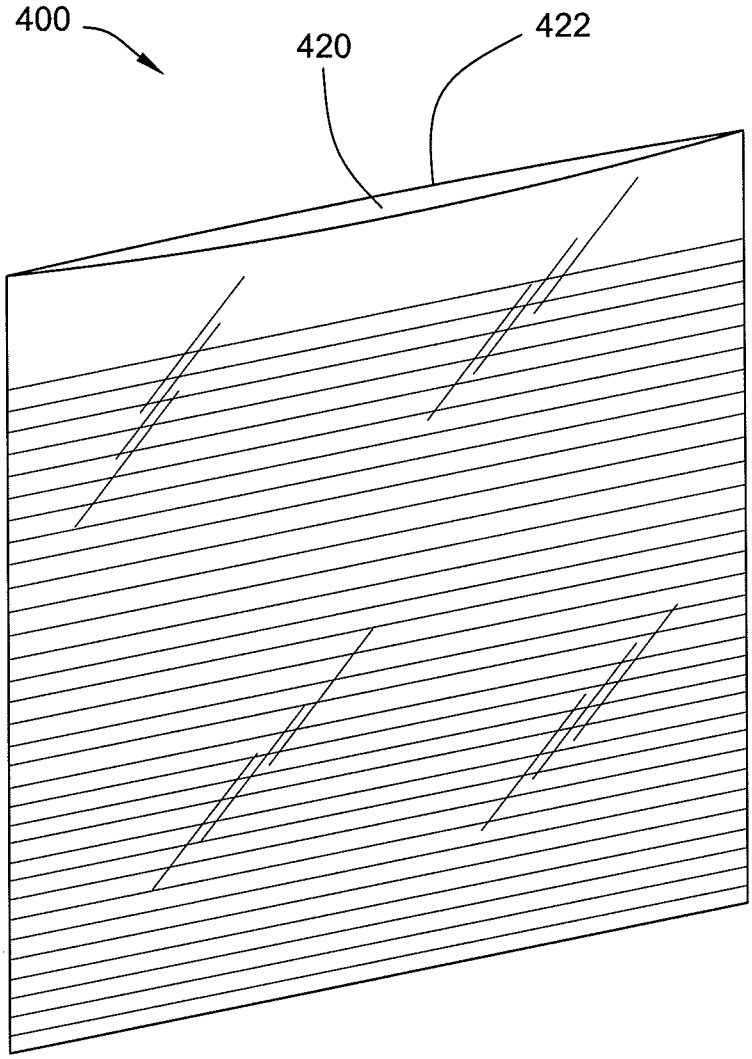
FIG. 9 is a perspective view of another embodiment of the thermoplastic bag for use as a trash receptacle liner having a ribbed pattern imparted onto a sidewall of the bag.

FIG. 9 illustrates another embodiment of a bag. The bag 400 may be similar to bag 300 except that the top edges 420, 422 of the sidewalls may be straight.

Figure 10:
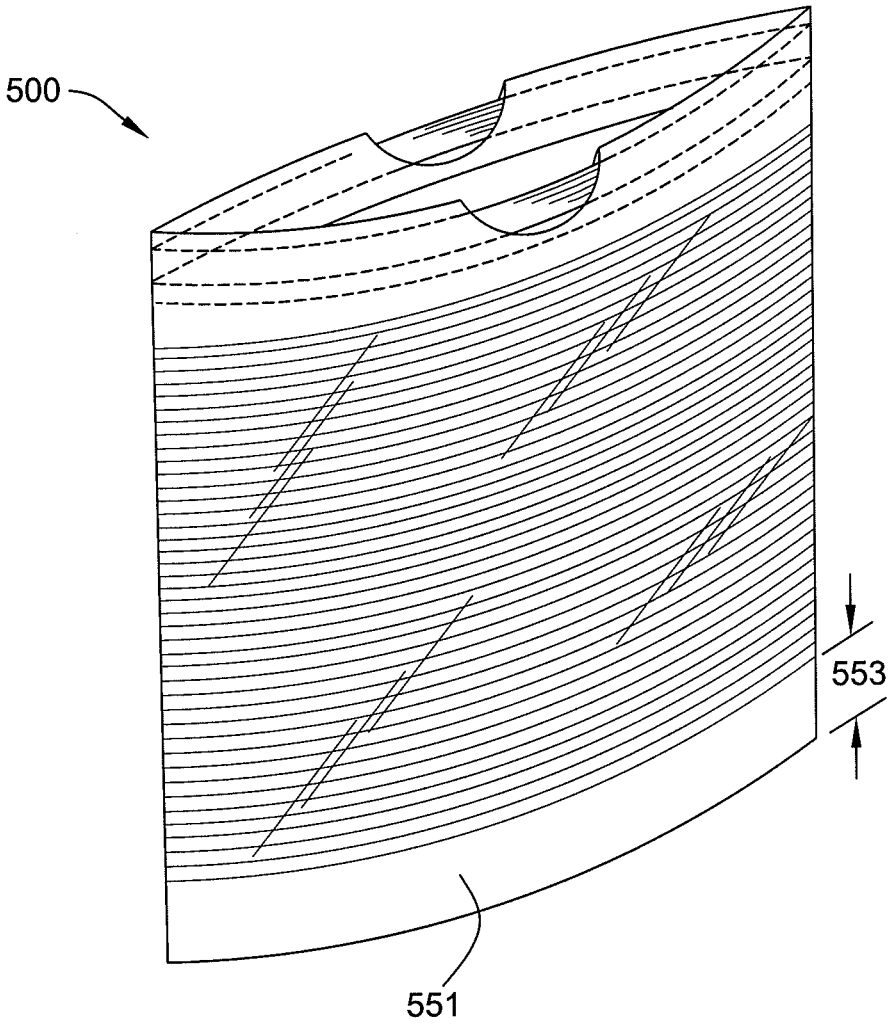
FIG. 10 is a perspective view of another embodiment of the thermoplastic bag for use as a trash receptacle liner having a ribbed pattern imparted onto a sidewall of the bag.
Figure 11:
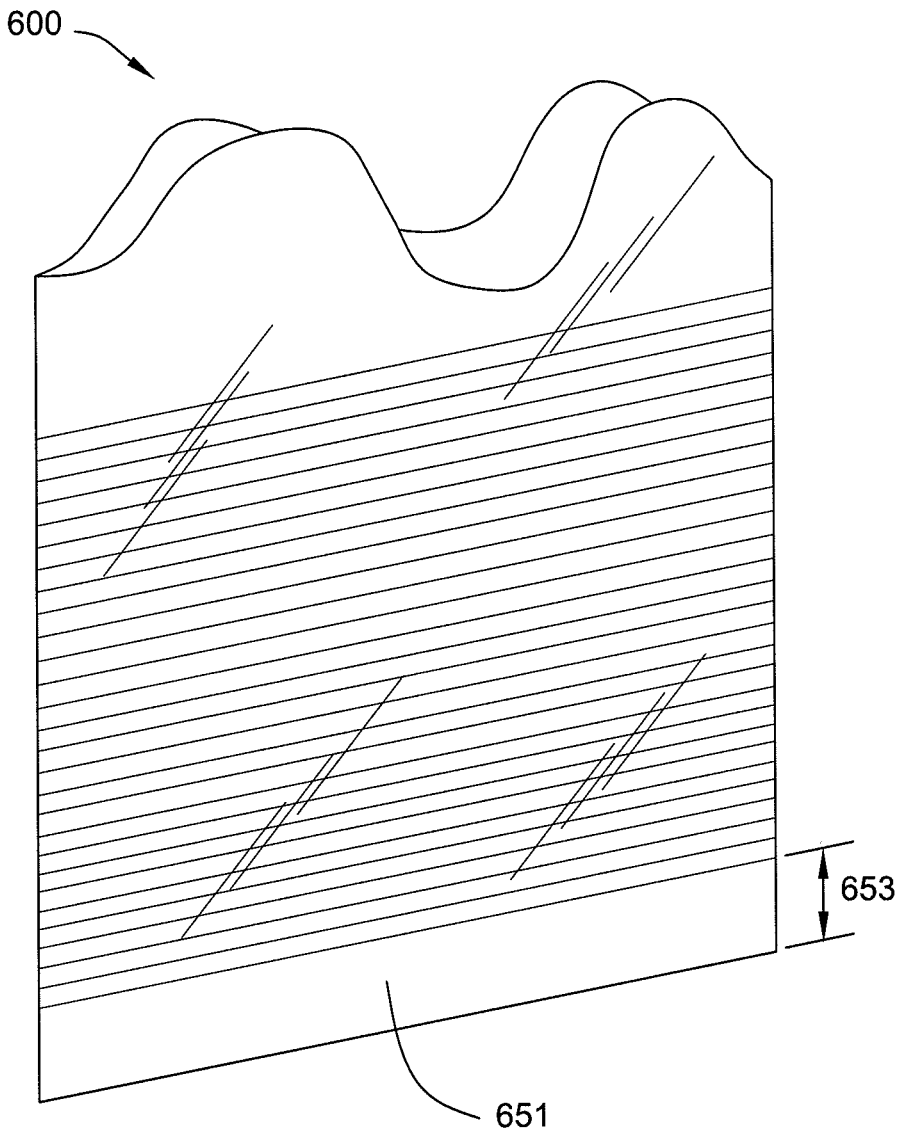
FIG. 11 is a perspective view of another embodiment of the thermoplastic bag for use as a trash receptacle liner having a ribbed pattern imparted onto a sidewall of the bag.

In other embodiments, the web may be processed so that the thicker material may be directed to other portions of the finished bag, such as the bottom portion shown in FIGS. 10, 11 and/or 12, that may otherwise be susceptible to rupture and/or puncture. FIG. 10 illustrates another embodiment of a bag. The bag 500 may be similar to bag 100 in FIG. 1 except that the bottom portion 551 may not have the ribbed pattern. The height 553 of this unprocessed bottom portion 551 may have any suitable dimensions with consideration to the web size. The height 553 may have a first range of about 3 inches (7.62 cm) to 9 inches (22.86 cm), a second range of about 4 inches (10.16 cm) to 8 inches (20.32 cm), and a third range of about 5 inches (12.70 cm) to 7 inches (17.78 cm). In one embodiment, the height 553 may be about 6 inches (15.24 cm).

FIG. 11 illustrates another embodiment of a bag. The bag 600 may be similar to bag 300 in FIG. 8 except that the bottom portion 651 may not have the ribbed pattern. The height 653 of the bottom portion 651 may have the dimensions as noted herein, such as, height 553 in FIG. 10.

Figure 12:
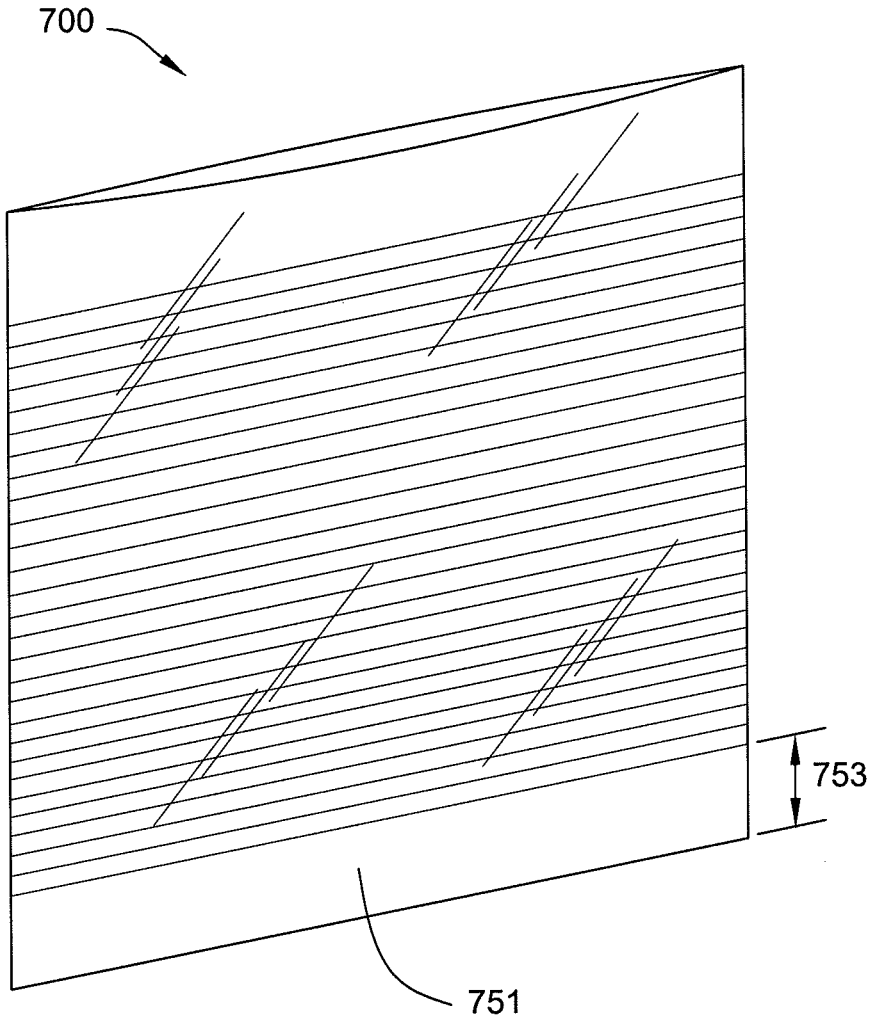
FIG. 12 is a perspective view of another embodiment of the thermoplastic bag for use as a trash receptacle liner having a ribbed pattern imparted onto a sidewall of the bag.

FIG. 12 illustrates another embodiment of a bag. The bag 700 may be similar to bag 400 in FIG. 9 except that the bottom portion 751 may not have the ribbed pattern. The height 753 of the bottom portion 751 may have the same dimensions as noted herein, such as, height 553 in FIG. 10.

Figure 13:
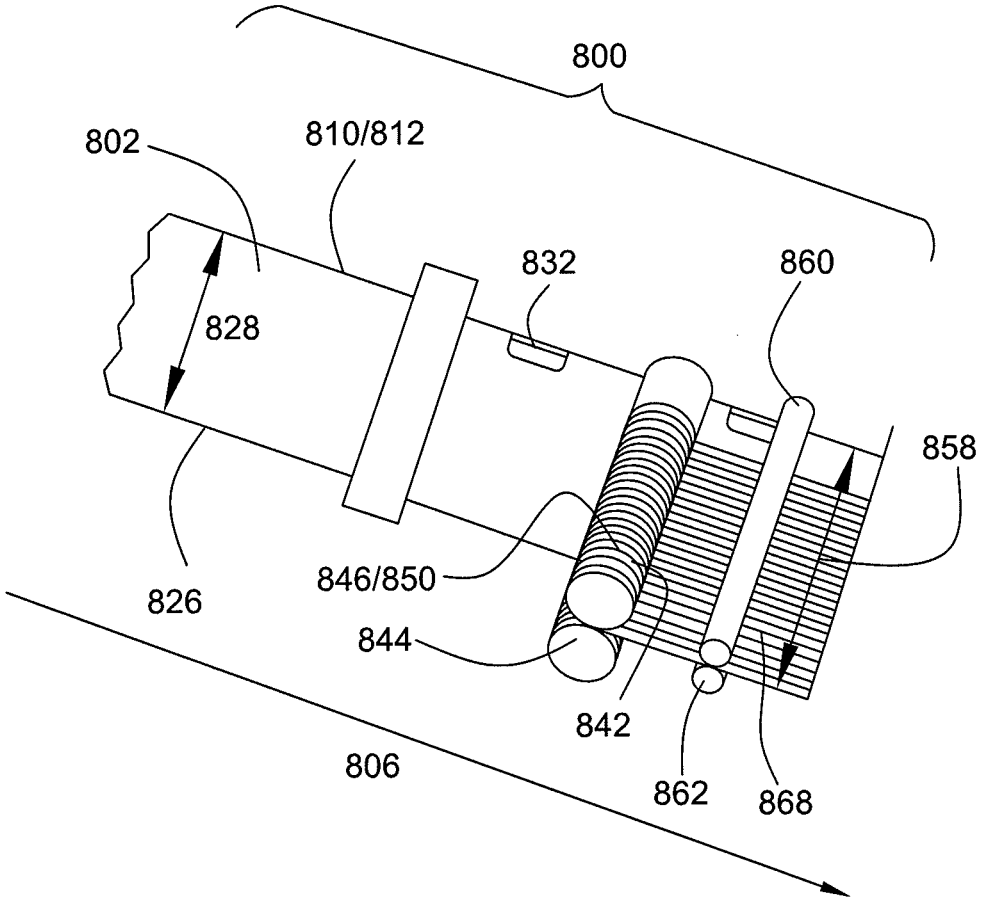
FIG. 13 is a schematic view of another embodiment of a high-speed manufacturing environment for producing thermoplastic bags having ribbed patterns.

Referring to FIG. 13, there is illustrated another embodiment of a manufacturing process 800 for producing a bag having a ribbed pattern imparted onto it. The process 800 may utilize rollers 842, 844 that may only extend partially along the width 828 of the web 802. Specifically, the rollers 842, 844, which may be perpendicular to the machine direction 806, may extend from proximate the outer edge 826 only part way towards the adjacent edges 810, 812. Thus, the adjacent edges 810, 812 and the corresponding portion of the web proximate those edges may extend beyond the length or reach of the rollers 842, 844. The full length of the cylindrical rollers 842, 844 may be formed with ridges and grooves 846, 850 like those described herein that impart the ribbed pattern. However, because the rollers 842, 844 may only extend partially across the width of the web, the ribbed pattern may not be imparted to the adjacent edges 810, 812 and the corresponding portion of the web 802 which may include the draw tape 832.

As described herein, imparting the ribbed pattern 868 onto the web 802 may increase the width of the web from a first width 828 to a larger second width 858. To facilitate the widening of the web, the processing equipment may include pinch rollers 860, 862. As illustrated, the pinch rollers 860, 862 may accommodate the growing width of the web while maintaining alignment of the web through the processing equipment.

Figure 14:
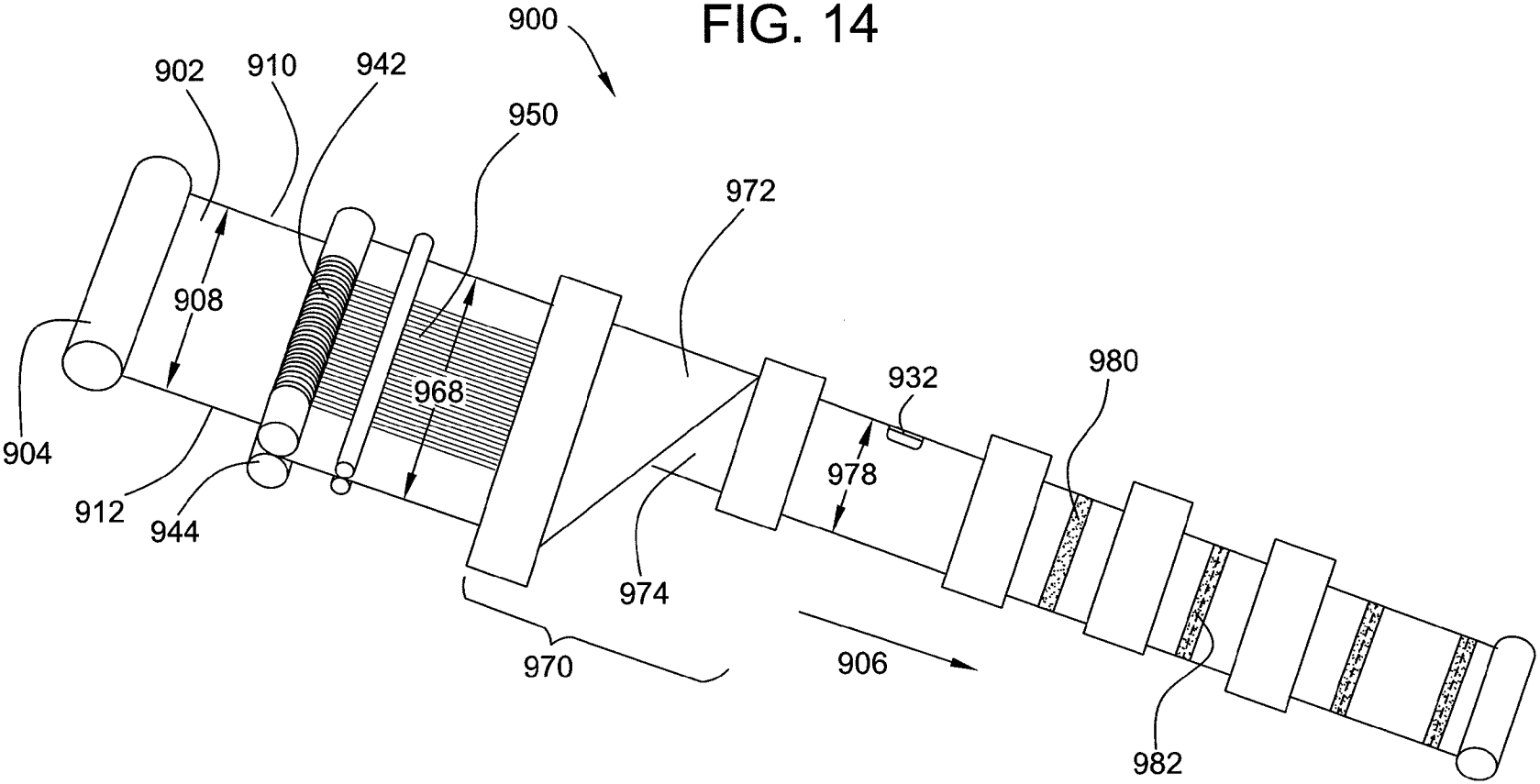
FIG. 14 is a schematic view of another embodiment of a high-speed manufacturing environment for producing thermoplastic bags having ribbed patterns.

Referring to FIG. 14, there is illustrated another embodiment of a manufacturing process 900 for producing a plastic bag having a ribbed pattern imparted onto it. According to the process, a thermoplastic web 902 may be unwound from a roll 904 and may be directed along a machine direction 906. The web 902 may have a width 908 perpendicular to the machine direction 906 and measured between a first edge 910 and a parallel second edge 912.

To impart the ribbed pattern 950 onto the web 902, first and second cylindrical rollers 942, 944 may be arranged in opposing, parallel relation along the web and may be perpendicular to the machine direction 906. The rollers 942, 944 may have a construction similar to that of FIGS. 6 and 7 including a plurality of circular spaced-apart ridges 956. The ridges 956 of the first roller 942 may fit between the corresponding ridges of the second roller 944 in the manner described herein. As the web passes between the first and second rollers 942, 944, the ribbed pattern 950 may be imparted into the thermoplastic material and the average thickness of the web may be reduced. After passing between the rollers 942, 944, the web 902 may have a second width 968 that is greater than that of the original width 908 of the unwound web.

To produce the sidewalls of the finished bag, the web 902 may be folded in half along the machine direction 906 by a folding operation 970 so that the first edge 910 is moved adjacent to the second edge 912. The folding operation 970 thereby provides a first web half 972 and an adjacent second web half 974, the overall width 978 which may be half the second width 968 of the web 902 after passing between the rollers 942, 944. The folded web 902 may proceed through subsequent other steps, such as, draw tape 932, side seals 980, and perforations 982 that allow individual bags to be separated from the web.

Figure 15:
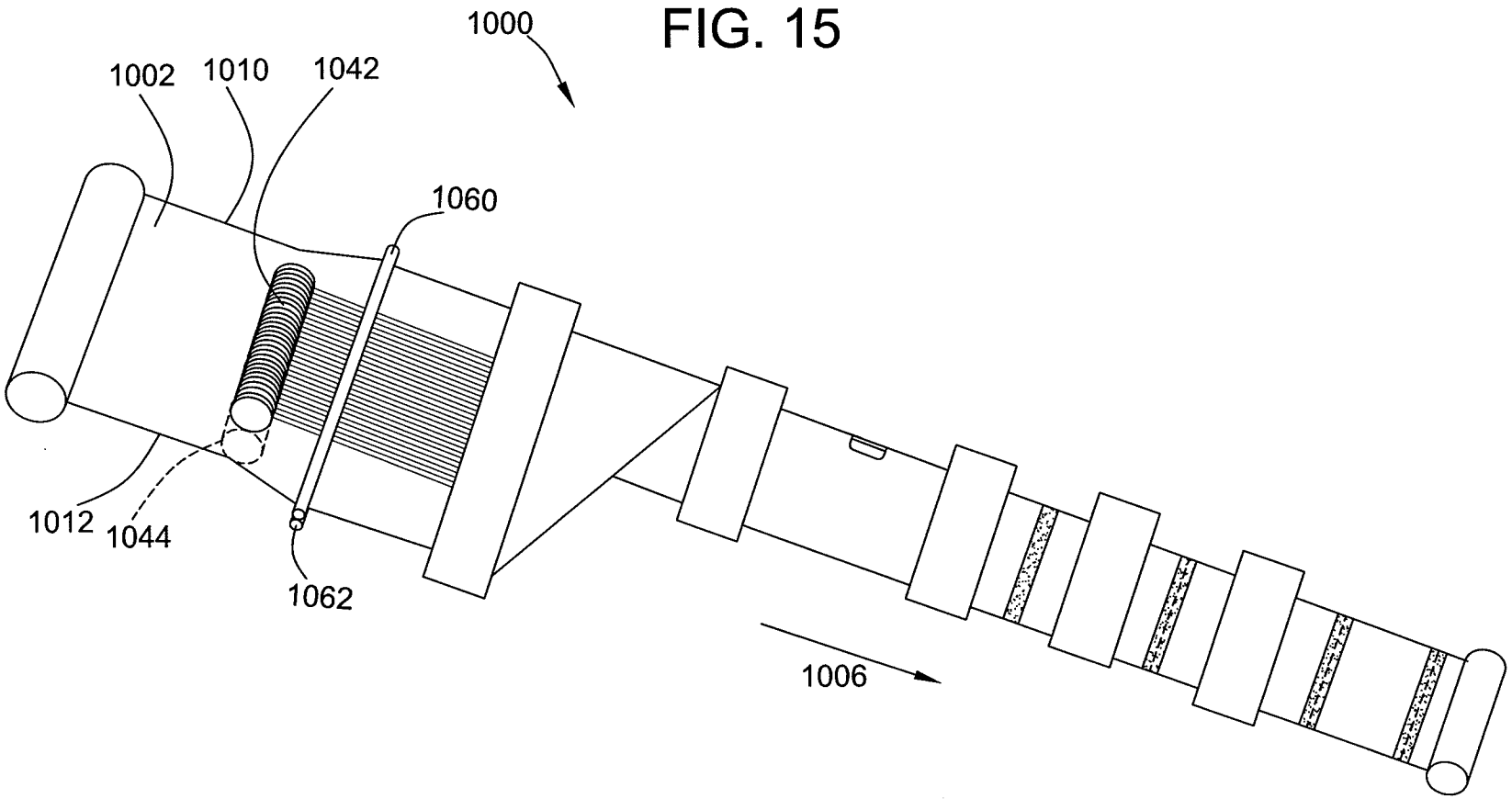
FIG. 15 is a schematic view of another embodiment of a high-speed manufacturing environment for producing thermoplastic bags having ribbed patterns.

Referring to FIG. 15, there is illustrated another embodiment of a manufacturing process 1000. The process 1000 may be similar to process 900 in FIG. 14 except that the process 1000 may include shorter rollers 1042, 1044. The process 1000 may utilize a pair of pinch rollers 1060, 1062 appropriately arranged to grasp the web and may be perpendicularly offset with respect to the machine direction 1006. When the web 1002 is processed between the rollers 1042, 1044 so as to stretch thermoplastic material in a direction lateral to the machine direction 1006, the pinch rollers 1060, 1062 may facilitate and accommodate the widening web 1002.

Figure 16:
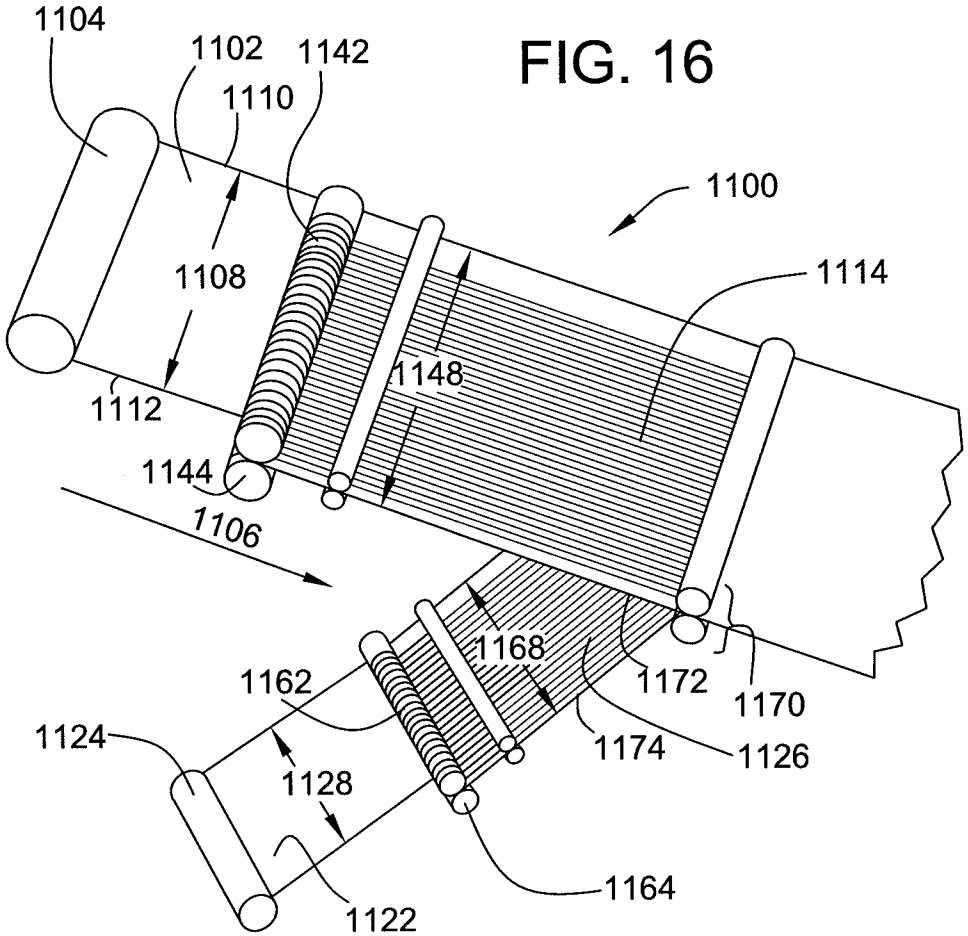
FIG. 16 is a schematic view of another embodiment of a high-speed manufacturing environment for producing thermoplastic bags having ribbed patterns.

Referring to FIG. 16, there is illustrated another embodiment of a manufacturing process 1100 for producing a bag having a ribbed pattern which utilizes first and second webs 1102, 1122 of thermoplastic material. The first and second webs 1102, 1122 may be provided initially as first and second rolls 1104, 1124 of web material. The first web 1102 may be unwound from the first roll 1104 and may be directed generally along a machine direction 1106. The unwound web may have a first width 1108 measured between parallel first and second edges 1110, 1112. To impart the ribbed pattern 1114 onto the first web 1102, a first pair of cylindrical rollers 1142, 1144 may be arranged perpendicular to the machine direction 1106 such that the web passes between the rollers. The rollers 1142, 1144 may process the thermoplastic material of the web 1102 so that the web has a second width 1148 that may be greater than the first initial width 1108.

The second web 1122 may be unwound from the second roll 1124 and may be directed between a second pair of cylindrical rollers 1162, 1164 which may be arranged perpendicularly to the web 1122 to impart a ribbed pattern 1126 onto it. Additionally, after passing between the rollers 1162, 1164, the second web 1122 may have a second width 1168 that may be greater than the initial width 1128 of the web. After passing between the cylindrical rollers 1162, 1164, the second web 1122 may be directed adjacent and parallel to the advancing first web 1102 in the machine direction. The adjacent first and second webs 1102, 1122 may proceed through a sealing operation 1170 that seals together an edge 1172 of the first web to an adjacent edge 1174 of the second web. It may be appreciated that the adjacent first and second webs 1102, 1122 may become the opposing sidewalls and that the sealed edges 1172, 1174 may become the bottom edge of a finished bag having a ribbed pattern. The joined webs may proceed through other processing steps to produce a finished bag.

Figure 17:
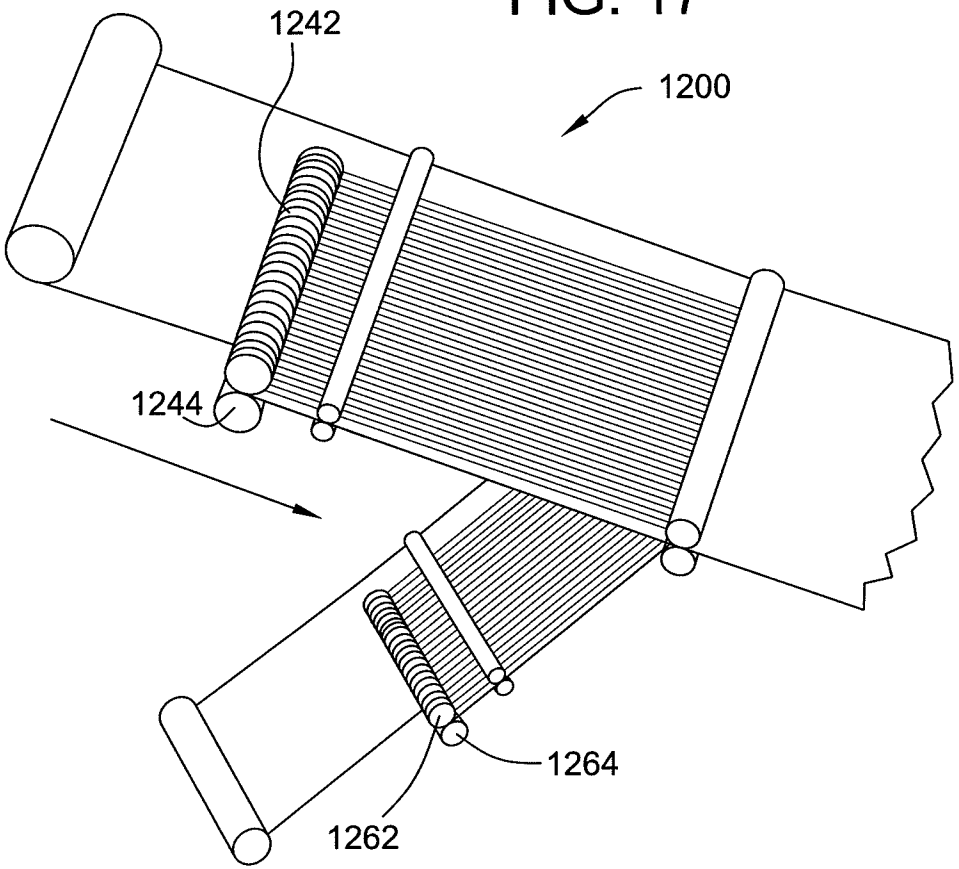
FIG. 17 is a schematic view of another embodiment of a high-speed manufacturing environment for producing thermoplastic bags having ribbed patterns.

Referring to FIG. 17, there is illustrated another embodiment of a manufacturing process 1200. The process 1200 may be similar to process 1100 in FIG. 16 except that the process 1200 may include shorter rollers 1242, 1244, 1262, 1264 as described herein.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Exemplary embodiments are described herein. Variations of those embodiments may become apparent to those of ordinary skill in the art upon reading the foregoing description. The inventor(s) expect skilled artisans to employ such variations as appropriate, and the inventor(s) intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A plastic bag prepared by a process comprising:

providing first and second cylindrical rollers, the rollers arranged parallel and adjacent to each other, the cylindrical surface of each roller having a plurality of circular ridges protruding radially outward, the plurality of circular ridges arranged parallel to and axially spaced apart from each other, the circular ridges of the first cylindrical roller being received between the spaced-apart circular ridges of the second cylindrical roller;

providing a continuous web of flexible thermoplastic film material, the web having an initial width measured between a first side edge and a second side edges, the web having an initial average thickness substantially consistent across the initial width;

folding the web about a fold line that is parallel to a machine direction;

rotating the first and second cylindrical rollers in opposite rotational directions;

advancing the web between the first and second rollers to imcrementally stretch only a portion the initial width of the web in a direction that is perpendicular to the machine direction; and imparting a pattern of a plurality of parallel linear ribs to the stretched portion of the web, the pattern corresponding to the circular ridges of the first and second rollers.

2. The plastic bag of claim 1, wherein the process further comprises forming a first sealed side edge between the first and second sidewalls perpendicular to the machine direction; and forming a second sealed side edge between the first and second sidewalls perpendicular to the machine direction, the second sealed side edge spaced apart from the first sealed side edge, the first sealed side edge, second sealed side edge and closed bottom edge defining an interior volume.

3. The plastic bag of claim 2, wherein the process further comprises perforating the sealed side edges.

4. The plastic bag of claim 1, wherein after the step of imparting the pattern, the width of the web is increased with respect to the initial width.

5. The plastic bag of claim 1, wherein after the step of imparting the pattern, the tensile-energy-to-yield of the patterned portion of the web, as measured in a transverse direction perpendicular to the machine direction, is increased by a factor of two or greater compared to the initial web.

6. The plastic bag of claim 1, wherein after the step of imparting the pattern, the average thickness of the patterned portion of the web is decreased with respect to the initial average thickness.

7. The plastic bag of claim 6, wherein the average thickness of the patterned portion of the web is decreased by about 40% from the initial average thickness.

8. The plastic bag of claim 1, wherein after the step of imparting the pattern, the web has a change in the balance of properties to where the transverse and machine direction tear resistances are about equal, or to where the web has a greater resistance to tearing in the machine direction than in the transverse direction.

9. A thermoplastic bag comprising:

a continuous web of flexible thermoplastic film material, the continuous web of flexible thermoplastic film material comprising:

a width measured between a first side edge and a second side edge;

a fold line about which the continuous web of flexible thermoplastic film material is folded to form a first sidewall and a second side wall;

first and second top edges opposite the fold line;

a first upper portion in the first sidewall that extends from the first top edge a first distance toward the fold line, the first upper portion having a first thickness that is substantially consistent across the first upper portion;

a second upper portion in the second sidewall that extends from the second top edge the first distance toward the fold line, the second upper portion having the first thickness that is substantially consistent across the second upper portion;

a first middle portion in the first sidewall that extends from the first upper portion toward the fold line;

a second middle portion in the second sidewall that extends from the second upper portion toward the fold line;

wherein the first middle portion and the second middle portion:

are stretched such that a thickness of the first and second middle portions varies along a height of the first and second middle portions and such that an average thickness of the first and second middle portions is less than the first thickness; and comprise a pattern of a plurality of parallel linear ribs that extend in a direction perpendicular to the first and second side edges.

10. The thermoplastic bag of claim 9, further comprising a closure mechanism integrated into the first and second upper portions.

11. The thermoplastic bag of claim 10, wherein the closure mechanism comprises a draw tape.

12. The thermoplastic bag of claim 9, further comprising:

a first side seal that secures the first side edge of the first sidewall to the first side edge of the second sidewall; and a second side seal that secures the second side edge of the first sidewall to the second side edge of the second sidewall.

13. The thermoplastic bag of claim 9, wherein the first and second upper portions of the thermoplastic bag have a first machine-direction tear resistance and a first transverse-direction tear resistance, the first transverse-direction tear resistance being greater than the first machine-direction tear resistance.

14. The thermoplastic bag of claim 13, wherein the first and second middle portions of the thermoplastic bag have a second machine-direction tear resistance and a second transverse-direction tear resistance, the second machine-direction tear resistance being approximately equal to the second transverse-direction tear resistance.

15. The thermoplastic bag of claim 13, wherein the first and second middle portions of the thermoplastic bag have a second machine-direction tear resistance and a second transverse-direction tear resistance, the second machine-direction tear resistance being greater than the second transverse-direction tear resistance.

16. The thermoplastic bag of claim 15, wherein the continuous web of flexible thermoplastic film material comprising linear-low density polyethylene.

17. The thermoplastic bag of claim 13, wherein:

the first and second upper portions of the thermoplastic bag have a first tensile-energy-to-yield; and the first and second middle portions of the thermoplastic bag have a second tensile-energy-to-yield, the second tensile-energy-to-yield being more than double the first tensile-energy-to-yield.

18. The thermoplastic bag of claim 17, wherein an average of the thickness of the first and second middle portions is decreased by about 40% compared to the first thickness of the first and second upper portions.

19. The thermoplastic bag of claim 9, wherein the continuous web of flexible thermoplastic film material further comprises:

a first bottom portion in the first sidewall that extends from the fold line a second distance to the first middle portion; and a second bottom portion in the second sidewall that extends from the fold line the second distance to the second middle portion;

wherein the first and second bottom portions have a second thickness that is equal to the first thickness and that is substantially consistent across the first and second bottom portions.

20. The thermoplastic bag of claim 19, wherein the first distance is equal to the second distance.

* * * * *